United States Patent [19]

Grove et al.

[11] Patent Number: 4,615,458

[45] Date of Patent: Oct. 7, 1986

[54] FLOATING ROOF TANK WITH RIM SPACE SEAL

[75] Inventors: Robert B. Grove, Plainfield; Steven W. Peters, Naperville; Martin L. Tellalian, Forest Park, all of Ill.

[73] Assignee: Chicago Bridge & Iron Company, Oak Brook, Ill.

[21] Appl. No.: 762,505

[22] Filed: Aug. 5, 1985

[51] Int. Cl.[4] ..... B65D 88/46; B65D 88/50

[52] U.S. Cl. ..... 220/222; 220/224

[58] Field of Search ..... 220/222, 224

[56] References Cited

U.S. PATENT DOCUMENTS

| | | | |
|---|---|---|---|
| 1,666,415 | 4/1928 | Gallagher | 220/224 |
| 1,979,657 | 11/1934 | Wiggins | 220/224 |
| 2,997,200 | 8/1961 | Giannini et al. | 220/222 |
| 4,191,303 | 3/1980 | Kinghorn, Sr. et al. | 220/222 |
| 4,287,999 | 9/1981 | Heisterberg | 220/222 |
| 4,353,478 | 10/1982 | Clark | 220/224 |
| 4,371,090 | 2/1983 | Ogarek et al. | 220/224 |
| 4,437,577 | 3/1984 | Myers et al. | 220/224 |

*Primary Examiner*—Steven M. Pollard

*Attorney, Agent, or Firm*—Marshall, O'Toole, Gerstein, Murray & Bicknell

[57] ABSTRACT

A vertical cylindrical liquid storage tank having a circular floating roof therein and a seal from the roof to the tank wall for preventing escape of vapor from stored liquid. The seal has metal flexible sections, which can be laterally bent, extending from the roof edge to the tank wall, with an elastomeric tip on the sections. Gaskets can fill in gaps or space between the sections to prevent escape of vapor.

12 Claims, 13 Drawing Figures

FIG. 3
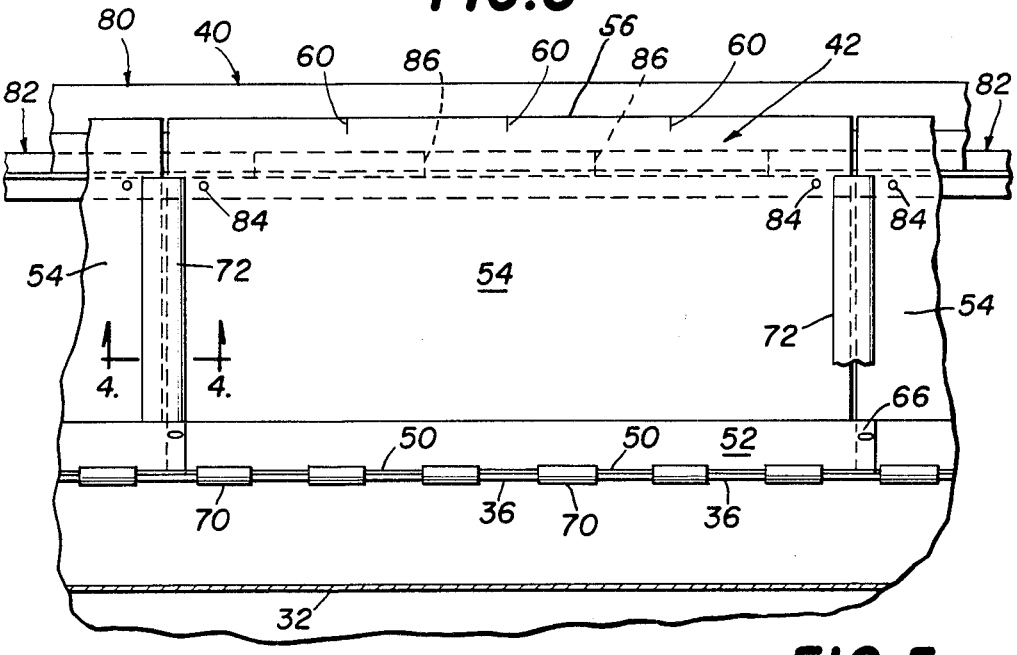
FIG. 4
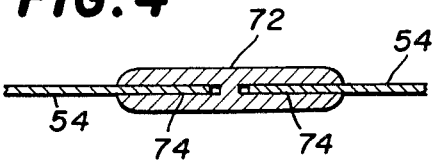
FIG. 5
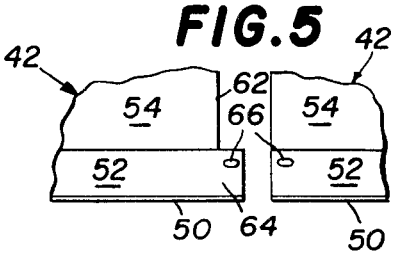
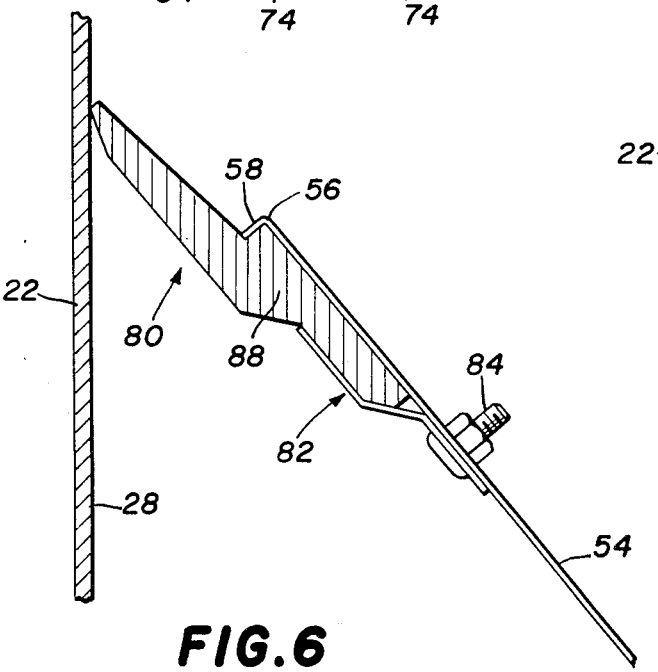
FIG. 6
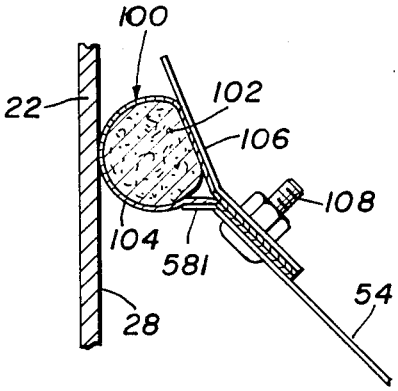
FIG. 7

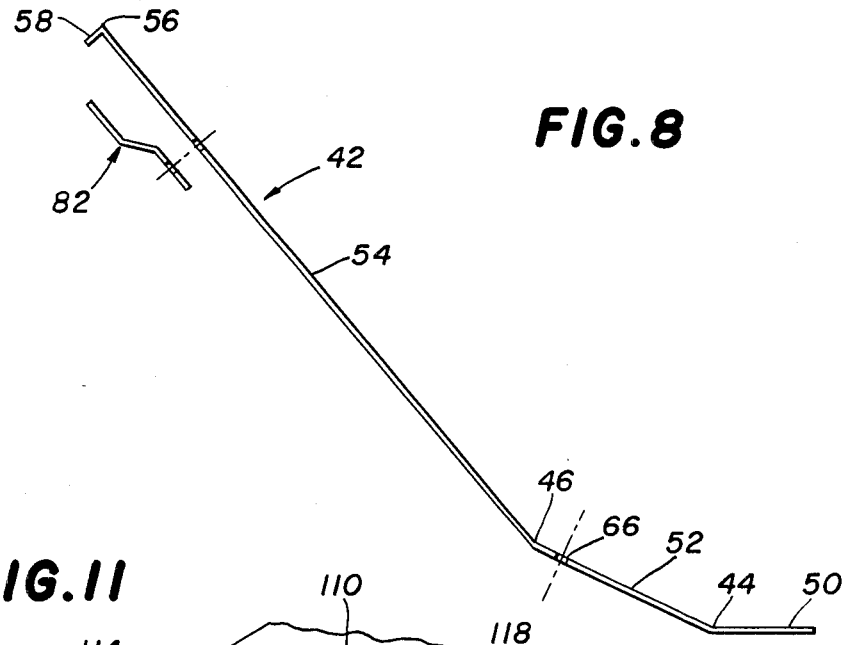
FIG. 8
FIG. 11
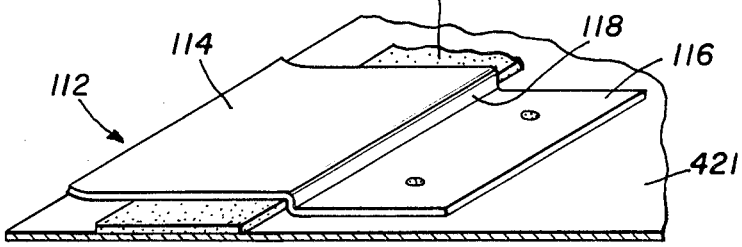
FIG. 9
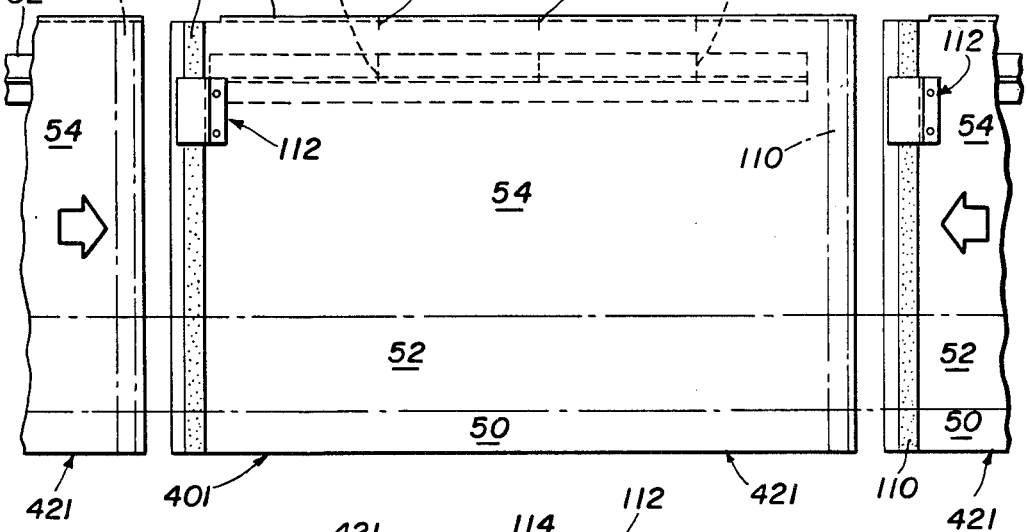
FIG. 10
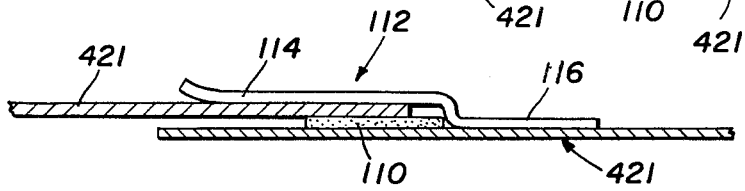

FLOATING ROOF TANK WITH RIM SPACE SEAL

This invention relates to floating roof tanks used for the storage of petroleum products and other volatile liquid materials. More particularly, this invention provides novel floating roof clearance space or rim seals which function as vapor and weather shields and sun screens.

BACKGROUND OF THE INVENTION

In a conventional floating roof tank, with which the seal of the invention is particularly useful, there is provided a clearance space or rim space between the tank side wall and the vertical rim of the floating roof. It is necessary to provide clearance space to permit unrestrained vertical travel of the roof within the tank. The clearance space is of sufficient size that local dimensional variations in the circularity of the tank sidewall or shell, commonly called out-of-roundness, which can result from uneven foundation settlement, imprecise fabrication or erection or unusual live loads such as high winds and the like, do not hamper vertical travel of the roof.

The clearance space in essentially all floating roof tanks is covered in one way or another to prevent escape of vapor from the stored liquid through the clearance or rim space to the atmosphere. Various types of seals are used for this purpose. Many of the seals not only are intended to prevent vapor escape but also to center the roof so that it moves vertically relatively freely and prevents enlargement of the clearance space on one side of the roof since that could lead to escape of vapor by disengagement of the seal from contact with the tank wall.

Kinghorn et al U.S. Pat. No. 4,116,358 and Thiltgen et al U.S. Pat. No. 4,308,968 disclose floating roof clearance space seals made of metal sections. However, the seals include a gas impermeable fabric which extends continuously around the perimeter of the roof. The installation and maintenance of the fabric is expensive and time consuming but is essential to keep vapor from escaping between adjacent metal sections.

Kinghorn et al U.S. Pat. No. 4,191,303 also discloses a seal made of metal sections. However, the adjacent metal sections have overlapping edge portions with elongated holes. Fastening means, such as bolts, extend through the holes but permit the metal sections to slide laterally to accommodate dimensional change in the clearance or rim space. Even though a gasket is provided between the overlapping edge portions of the metal sections, to prevent vapor escape through the elongated holes and to the atmosphere large washers are needed to cover the elongated holes. Additionally, installation of the seal is time consuming because of the many bolts used, each of which requires precise tightening so as to permit lateral movement while keeping the gasket slightly compressed.

An additional problem with prior art seals is that the metal sections are made straight or flat and only become arced or bent when pressure is applied to them when installed or when the space between the roof edge and the tank wall is reduced during lateral movement of the roof during use. When the top edge of a metal section hits a protrusion, such as a weld or rivet, as the roof rises the metal section can buckle upwards and further lodge against the protrusion. Bending one or more of the metal sections in this manner is undesirable since it can damage the sections and open the seal.

Because of the described disadvantages and shortcomings in the previously available seals, a need exists for alternative seals for floating roof tanks.

SUMMARY OF THE INVENTION

According to one aspect of the invention there is provided a vertical cylindrical liquid storage tank having a circular floating roof of smaller diameter than the tank thereby defining a clearance space between the roof edge and the tank wall; a seal joined to the roof and extending upwardly therefrom into slidable contact with the tank wall; the seal completely covering the clearance space; the seal comprising a plurality of individual flexible sections of sheet material in consecutive continuous arrangement; means preventing vapor flow past adjoining side edges of adjacent flexible sections to the atmosphere; and, the sheet material of each flexible section having a permanent lateral bend positioned outwardly from the roof edge thereby increasing the concavity of the flexible section when viewed from the top.

According to another aspect of the invention there is provided a vertical cylindrical liquid storage tank having a circular floating roof of smaller diameter than the tank thereby defining a clearance space between the roof edge and the tank wall; a seal joined to the roof and extending upwardly therefrom into slidable contact with the tank wall; the seal completely covering the clearance space; the seal comprising a plurality of individual flexible sections of sheet material in substantially side-by-side but spaced apart arrangement; an elongated elastomeric strip between the side edges of adjacent flexible sections; each elastomeric strip having a groove in the two opposing longitudinal side edges into which the adjoining side edges of adjacent sections extend in a vapor tight slidable arrangement; and a flexible elastomeric tip joined to the outer end of the sections and in slidable contact with the tank wall.

Although the seal sections can be made of any suitable material, they are desirably made of a material having resilient or spring properties so that they can press firmly, but in a flexible manner, against the tank wall. The material used is desirably metal although polymeric materials which are stable in the tank environment can also be used. Polyethylene, polypropylene and copolymers of ethylene and propropylene can be used for storage of some liquids. The elastomeric tip desirably is an integral elongated member or strip with its inner side portion secured to a plurality of sections to hold it in place.

Each section can have a clamping bar along its outer end. The elastomeric tip can be held in place, on each section, by and between the clamping bar and the section. The clamping bar can form a pocket into which the inner side portion of the elastomeric tip can fit in retaining contact.

In another embodiment, the elastomeric tip can comprise an elastomeric rod constituting a core covered by an abrasion resistant flexible sheet material envelope joined to the outer end of each section.

According to another aspect of the invention there is provided a vertical cylindrical liquid storage tank having a circular floating roof of smaller diameter than the tank thereby defining a clearance space between the roof edge and the tank wall; a seal joined to the roof and extending upwardly therefrom into slidable contact with the tank wall; the seal completely covering the clearance space; the seal comprising a plurality of individual flexible sections of sheet material in substantially side-by-side arrangement but with adjacent section side edge portions overlapping each other; a gasket between the overlapping side edge portions; a clip attached to each section adjacent its edge portion which is overlapped by the edge portion of an adjacent section; the clip having a wing spaced upward from the section to which it is attached and extending over the edge portion of the adjacent section to press the edge portions together but permit the edge portions to slide laterally with respect to each other; and a flexible elastomeric tip joined to the outer end of the sections and in slidable contact with the tank wall.

In the first embodiment of the invention which incorporates the bent flexible sections, flow of vapor past the adjoining edges of the sections to the atmosphere can be prevented by use of any suitable means, including a continuous fabric layer over the top of the seal. However, it is preferred to use the grooved elastomeric strip or the gasket arrangement described above and herein. Nevertheless, the grooved elastomeric strip and gasket arrangement are not limited to use with bent flexible sections but can be suitably employed with unbent sections and permanently arced flexible sections.

Elastomeric tips such as described above can be used in all the described seals.

The clip wing can be substantially planar, have a planar base attached to the section and the wing and base can be located in parallel spaced apart planes. More specifically, the clip wing and base can be integral with a lateral shoulder portion, with the wing and base extending in opposite directions.

The overlapping edge portions of the sections desirably have continuous surfaces free of holes with no fasteners penetrating therethrough.

Each section and clip are desirably made of a suitable metal, particularly a suitable grade of stainless steel. Polymeric materials, however, which are stable under the conditions of use, can also be employed for the sections and clips.

BRIEF DESCRIPTION OF THE DRAWINGS

FIG. 3 is an elevational view of a portion of the floating roof shown in FIGS. 1 and 2;

FIG. 4 is a sectional view of the elastomeric strip taken along the line 4—4 of FIG. 3;

FIG. 5 is an exploded partial view of the adjoining edges of two sheet metal sections;

FIG. 6 is an enlarged sectional view of the unbent elastomeric tip at the outer ends of the sheet metal sections;

FIG. 7 is a sectional view of an alternative elastomeric tip which can be used on the outer ends of the sheet metal sections;

FIG. 8 is an exploded end view of a sheet metal section and elastomeric tip clamping bar;

FIG. 9 is an elevational exploded view of a portion of an embodiment of floating roof seal according to the invention in which adjoining sheet metal section edges are to be overlapped and movably secured by a clip;

FIG. 10 is a sectional view of the seal shown in FIG. 9 but with adjoining edges of two metal sections overlapped and secured by a clip;

FIG. 11 is an isometric view of the seal portion shown in FIG. 10;

DETAILED DESCRIPTION OF THE DRAWINGS

To the extent it is reasonable and practical the same or similar elements which appear in the various views of the drawings will be identified by the same numbers.

Figure 1:
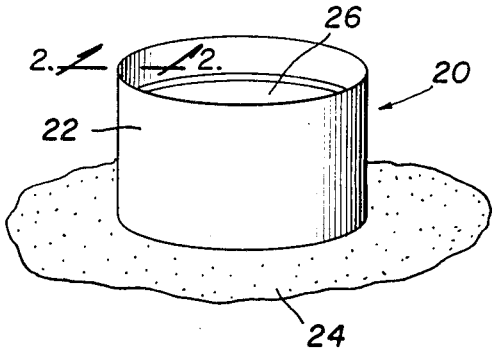
FIG. 1 is an isometric view of a liquid storage tank have a floating roof.

The liquid storage tank 20 shown in FIG. 1 has a vertical cylindrical circular wall 22 which is joined at its lower edge to a flat circular metal bottom, not shown, which rests on a support base 24. Floating roof 26 moves up and down in tank 20 with the rise and fall of liquid stored in the tank.

Floating roof 26 is circular and is of conventional construction except for the novel seals, provided by the invention, positioned on its upper peripheral edge and which span the rim space 30 to contact the tank wall 22 inner surface 28. The floating roof 26 has a top deck plate 32 and a vertical circular peripheral side wall 34 which extends above deck plate 32. Inwardly extending horizontal circular flange 36 is joined to the top edge of roof side wall 34 (FIG. 2).

Figure 2:
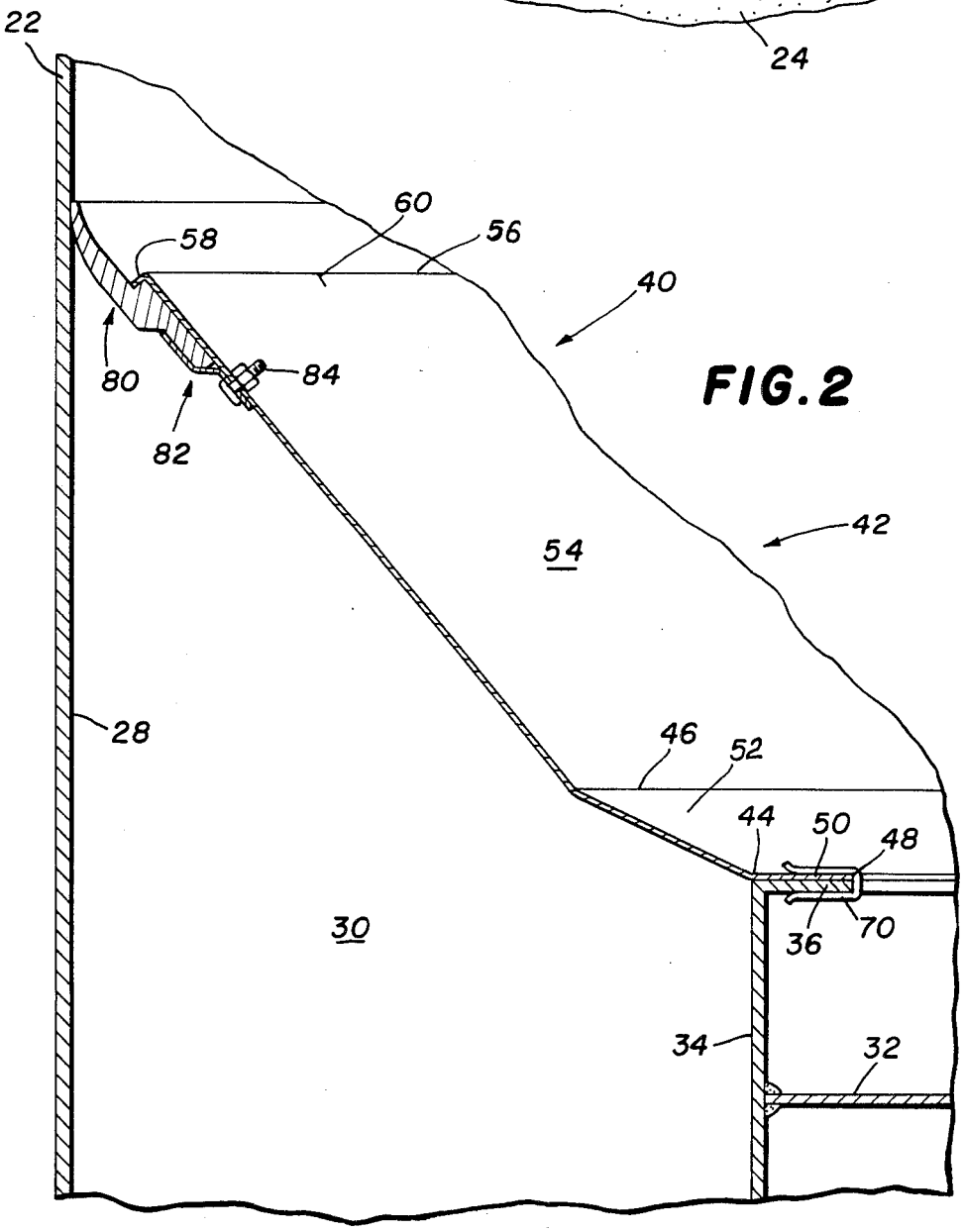
FIG. 2 is a vertical radial sectional view of the floating roof in the tank shown in FIG. 1.

The rim space or clearance space 30 is completely covered by seal 40 joined to floating roof flange 36 and extending upwardly therefrom into slidable contact with the inner surface 28 of tank wall 22 (FIG. 2).

Figure 12:
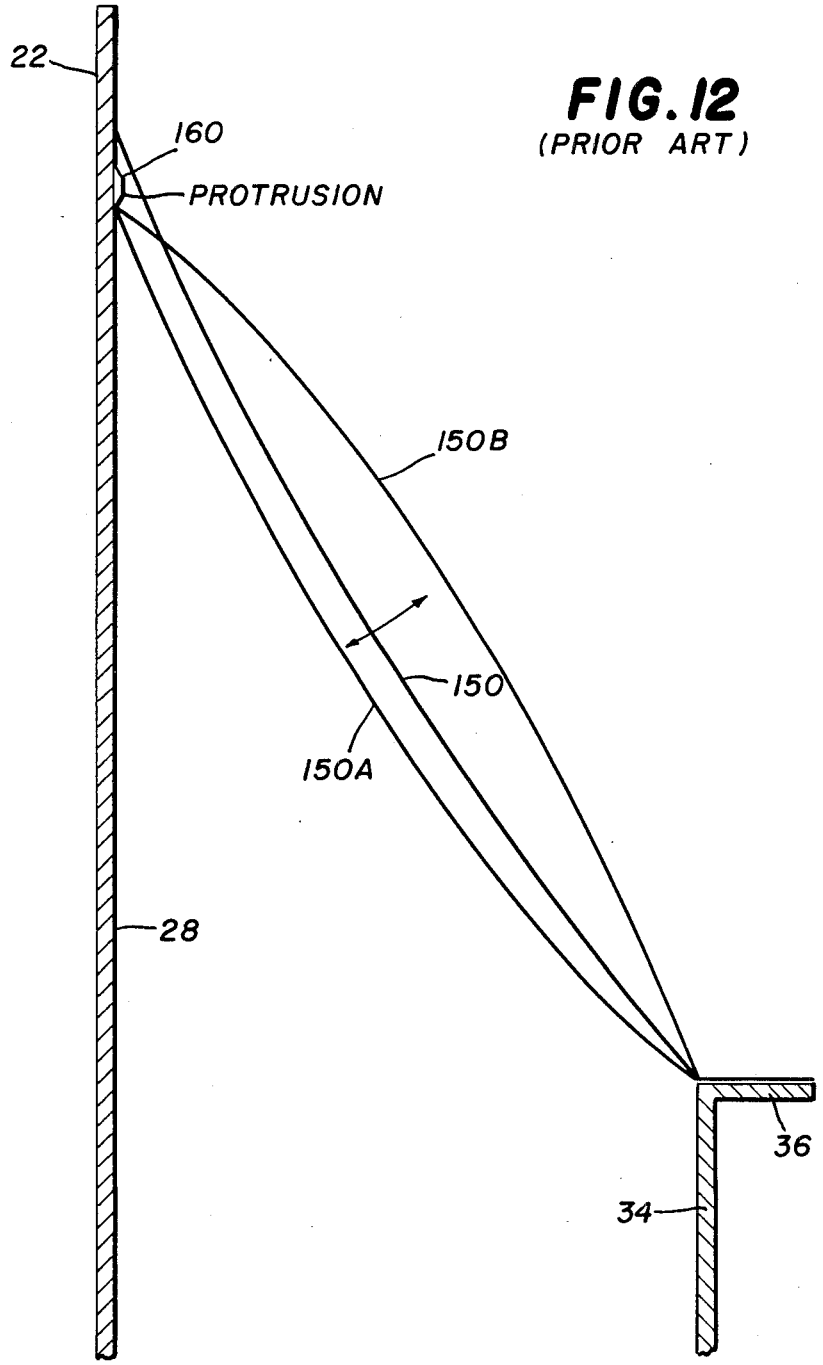
FIG. 12 (PRIOR ART)
FIG. 12 is a schematic view of the way a prior art seal made of unbent flexible sections react when they hit a protrusion on a tank wall.
Figure 13:
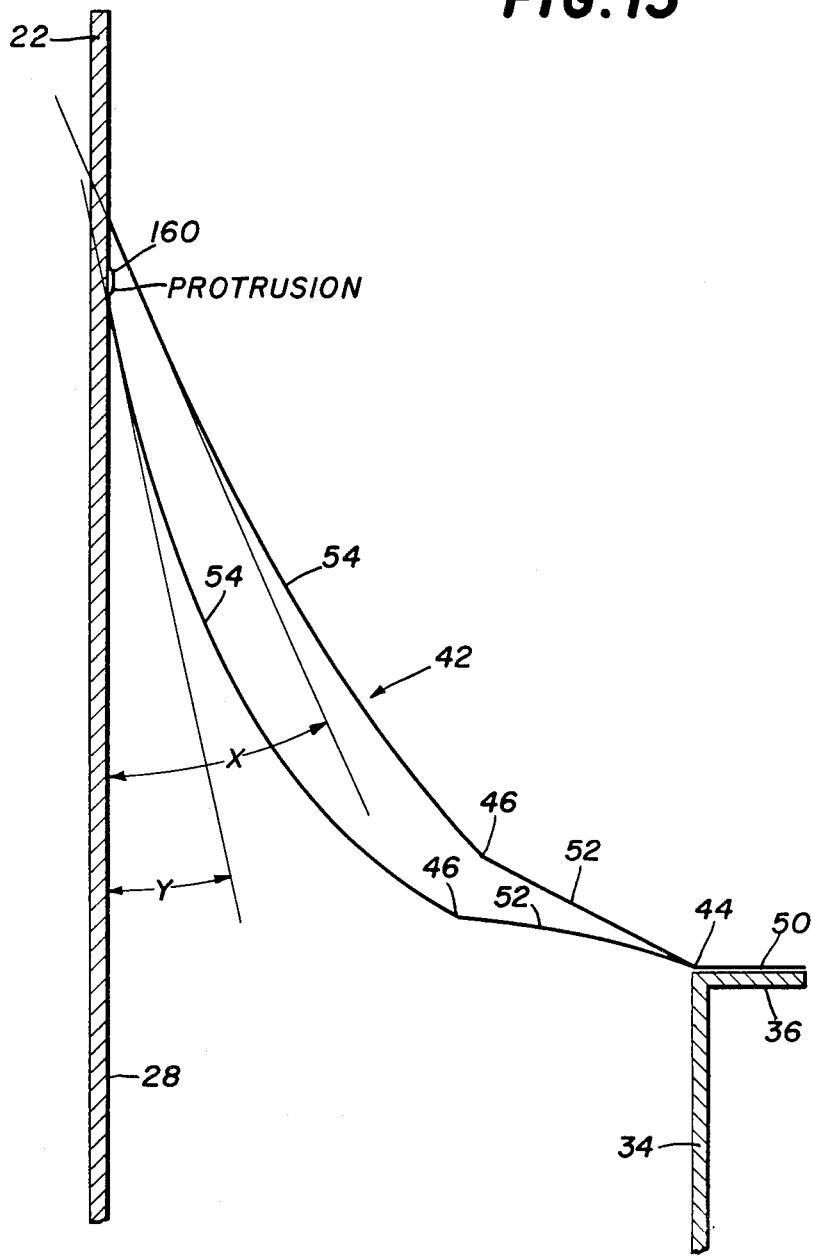
FIG. 13 is a schematic view of the way the bent flexible sections shown in FIGS. 2 and 9 react when they hit a protrusion on a tank wall.

Seal 40 includes a plurality of individual identical flexible sections 42 of sheet metal in substantially side-by-side but spaced apart arrangement (FIG. 3). The flexible metal sections 42 are substantially rectangular. However, sections 42 are bent at lateral lines 44 and 46 at the inner or lower portions, which are parallel to each other and to the inner edge 48 (FIG. 2). The metal section portion 42 between edge 48 and bend line 44 constitutes a horizontal clamping strip 50 which is secured to flange 36 by a plurality of side-by-side C-clips 70. The metal section portion 42 between bend lines 44 and 46 is a transition band 52 while the portion between bend line 46 and the outer or top edge 56 constitutes the primary body portion 54. The lateral bend line 46 gives each metal section 42 a permanent concave shape when viewed from the top. This shape prevents the sections from buckling upwardly when a section upper edge engages a protrusion, such as a weld or rivet (FIGS. 12 and 13). The transition band 52 forms a stiff shallow cone which acts as a short cantilever to carry the bending load. The primary body portion 54 carries the membrane compression load against the shell. The outer edge 56 has a short downwardly directed lip 58 which is interrupted by spaced apart cuts or slits 60 (FIG. 3). The slits 60 are provided so that the lip 58 does not prevent the shield outer edge 56 from curving to approximate the curvature of the tank wall.

The clamping strip 50 and the transition band 52 of each metal section 42 extends beyond one side edge 62 (FIG. 5) of primary body portion 54 and defines a tab 64 which overlaps the edge of an adjacent metal section 42. Elongated holes 66 are provided in the tab 64 and the edge of the adjacent metal section 42 so that they can be secured together loosely by a bolt.

Elastomeric strip 72 (FIGS. 3 and 4) is positioned between the spaced apart side edges of adjacent metal sections 42. Each elastomeric strip 72 has a groove 74 in the two opposing longitudinal side edges into which the adjoining side edges of adjacent sections 42 extend in a vapor tight slidable arrangement. In this way, the space between the sections 42 is sealed even when that space increases or decreases as the roof moves towards or away from the tank wall surface 28 and the seal 40 bends up or down.

The outer end of each metal section 42 supports a flexible elastomeric tip 80 which is removably secured in place by clamping bar 82 which is attached to body portion 54 by bolts 84 or by welding. The clamping bar forms a pocket into which the inner side portion 88 of the elastomeric tip fits in retaining contact. The lip 58 on the end of each section 42 also aids in securing tip 80 in place. Spaced apart slits 86 can be cut in clamping bar 82 to permit it to flex readily.

The flexible elastomeric tip 80 is desirably made as long as can be conveniently handled so as to reduce the number of joints required to extend it around the roof seal. Accordingly, the elastomeric tip 80 is fabricated to be an elongated member with its inner side portion 88 secured to a plurality of sections 42. When the tip is fabricated in sections, the adjoining ends of sections can be cut and contoured to overlap to produce a joint with good sealing capability.

It should be understood that FIG. 6 shows a cross-sectional view of the tip 80 in an as-extruded shape and before any pressure is applied to it when the seal is installed. Some initial pressure must be placed on seal 40 to cause the sections 42 and tip 80 to curve upwardly when the seal is installed so as to keep the tip in contact with the tank inner surface 28 when the roof moves as far away therefrom as it can. This will cause the tip to curve upwardly. When the roof moves closer to the tank wall inner surface 28 the curve of sections 42 and tip 80 will change and extend higher and more upright.

FIG. 7 illustrates an alternative elastomeric tip 100 which can be used on the seal 40. In this embodiment, the outer edge of primary body portion 54 has a flange 581 bent downwardly about 45° and provided with radial slits to allow ready flexing of the portion 54. An elongated elastomeric rod 102, constituting a core, is covered by an abrasion resistant elastomeric sheet material envelope 104. The rod may be solid, hollow, foamed or cellular. The longitudial edges of envelope 104 are gathered together on the upper surface of body portion 54 and secured in place by clamping bar 106 which is bolted 108 to body portion 54 with the envelope edges therebetween. A seal of this structure is particularly useful when the tank inner surface is rough or has protrusions, such as rivet heads or overlapping plate joints. Also, this embodiment lends itself to the use of more exotic and expensive materials. The volume of the sheet envelope is small and therefore reduces the amount of chemically resistance material required so it would be especially useful if an expensive material, i.e. Viton, were required. Viton is roughly six times more expensive than other seal materials.

FIGS. 9 to 11 illustrate another seal 401 provided by the invention; however, the elastomeric tip forming part of the seal for convenience is not included in these figures. It should be understood that either of the elastomeric tips 80 or 100 can be used in seal 401.

The individual metal sections 421 are like sections 42 except that sections 421 have straight side edges and no tab 64. At least one side edge of a section 421 is provided with a gasket strip 110 attached on the top or bottom surface such that the adjacent side edge of an adjacent section 421 slidably rests in contact with gasket 110. Also, both adjoining side edges of adjacent sections 421 can have a gasket applied thereto so that both gaskets become sandwiched between the side edges of sections 421 when they are overlapped. A clip 112 holds the edges in this slidable arrangement so that vapor is prevented from flowing between the overlapped edges.

Clip 112 is joined or attached to the edge portion of one of the sections 421, and desirably is secured to the section to which the gasket is fixedly applied. Metal clip 112 has a wing 114 spaced upward from the section 421 to which it is attached. The clip wing 114 is substantially planar. Also, the clip has a planar base 116 attached to section 421. The wing 114 and base 116 are in parallel spaced apart planes and are integral with a lateral shoulder portion 118 (FIG. 11). The wing 114 and base 116 extend in opposite directions from the shoulder portion 118. Wing 114 extends over the edge portion of the adjacent section 421 to press the edge portions, which have continuous surfaces, together but permit the edge portions to slide laterally with respect to each other.

The clip may also be shop installed allowing the use of spot welding. Some field installations do not allow any hot work and thus welds could not be used if clips were used and field installed.

FIG. 12 illustrates how a prior art flexible metal section 150 can react when the upper edge hits a protrusion 160, such as a rivet or weld, on the tank wall. The prior art metal section 150 is not prebent or curved from where it joins the roof to its upper edge. It is essentially a flat sheet over that area. When installed on a tank roof it acquires an arced shape because of the pressure applied by it against the tank wall.

As shown in FIG. 12, when the upper edge of section 150 hits protrusion 160, the section can buckle as shown by line 150A. However, it can also buckle upwardly as shown by line 150B. An upward buckle is very undesirable since it can deform the seal structure and let vapor escape.

FIG. 13 illustrates how the metal flexible sections provided by the invention react when they encounter a protrusion, such as a rivet or weld, on the tank wall. Because of the lateral bend line 46, the bent metal section 42 having initial angle X will have a natural tendency to curve or bend down to a smaller angle Y which will favor or promote upward movement of the section edge or tip over the protrusion. Upward buckling of the section is thereby avoided.

The foregoing detailed description has been given for clearness of understanding only, and no unnecessary limitations should be understood therefrom, as modifications will be obvious to those skilled in the art.

What is claimed is:

1. A vertical cylindrical liquid storage tank having a circular floating roof of smaller diameter than the tank thereby defining a clearance space between the roof edge and the tank wall;

a seal joined to the roof and extending upwardly therefrom into slidable contact with the tank wall;

the seal completely covering the clearance space;

the seal comprising a plurality of individual flexible sections of sheet material in substantially side-by-side arrangement but with adjacent section side edge portions overlapping each other;

a gasket between the overlapping side edge portions;

a clip attached to each section adjacent its edge portion which is overlapped by the edge portion of an adjacent section;

the clip having a wing spaced upward from the section to which it is attached and extending over the edge portion of the adjacent section to press the edge portions together but permit the edge portions to slide laterally with respect to each other; and a flexible elastomeric tip joined to the outer end of the sections and in slidable contact with the tank wall.

2. A storage tank according to claim 1 in which the clip wing is substantially planar, the clip has a planar base attached to the section and the wing and base are located in parallel spaced apart planes.

3. A storage tank according to claim 1 in which the clip wing and base are integral with a lateral shoulder portion, and the wing and base extend in opposite directions.

4. A storage tank according to claim 1 in which the section overlapping edge portions present continuous surfaces.

5. A storage tank according to claim 1 in which continuous surfaces contain no fasteners penetrating therethrough.

6. A storage tank according to claim 1 in which the sections are metal.

7. A storage tank according to claim 1 in which the sections are made of a polymeric material.

8. A storage tank according to claim 1 in which the clips are metal.

9. A storage tank according to claim 1 in which the elastomeric tip is an elongated member with the inner edge secured to a plurality of sections.

10. A storage tank according to claim 9 in which each section has a clamping bar along its outer end and the elastomeric tip is held in place, on each section, by and between the clamping bar and the section.

11. A storage tank according to claim 10 in which the clamping bar forms a pocket into which the inner edge of the elastomeric tip fits in retaining contact.

12. A storage tank according to claim 9 in which the elastomeric tip comprises an elastomeric rod constituting a core covered by an abrasive resistant flexible sheet material envelope joined to the outer end of each section.

* * * * *